United States Patent [19]

Hayes

[11] 4,235,557

[45] Nov. 25, 1980

[54] DISPENSER

[75] Inventor: Thomas H. Hayes, Baton Rouge, LA

[73] Assignee: Ethyl Corporation, Richmond, Va.

[21] Appl. No.: 972,689

[22] Filed: Dec. 26, 1978

[51] Int. Cl.[3] ..... B43K 19/00

[52] U.S. Cl. ..... 401/49; 401/82; 401/98

[58] Field of Search ..... 401/49, 86, 87, 88, 401/98, 131, 82

[56] References Cited

U.S. PATENT DOCUMENTS

| | | | |
|---|---|---|---|
| 1,557,608 | 10/1925 | Perkins | 401/88 |
| 3,162,885 | 12/1964 | Tanner | 401/131 |
| 3,453,056 | 7/1969 | Motsavage et al. | 401/49 X |

FOREIGN PATENT DOCUMENTS

| | | | |
|---|---|---|---|
| 538021 | 6/1922 | France | 401/98 |
| 1019951 | 4/1953 | France | 401/98 |
| 599730 | 11/1959 | Italy | 401/98 |

*Primary Examiner*—John D. Yasko

*Attorney, Agent, or Firm*—Donald L. Johnson; John F. Sieberth; Edgar E. Spielman, Jr.

[57] ABSTRACT

A device is disclosed for the packaging and dispensing of a hot-fill solid product such as solid antiperspirant. The device provides for product holding structure which will have selectively attached thereto a cover which will, along with the produce holding structure, provide a cavity into which the hot-fill product may be introduced. Also attached to the product holding structure is a handle. In use, the cover is removed from the product holding structure to expose the product so that it may be applied. The cover may have a structure on its outside surface for supporting the device in an upright position with the cover being at the bottom and the handle at the top. Alternatively, the handle may have supporting structure which will allow setting of the device down on the handle so that the handle is on the bottom and the cover is on the top.

12 Claims, 7 Drawing Figures

DISPENSER

Background of the Invention

Present day devices for packaging and dispensing hot-fill solid products such as solid antiperspirants are receiving wide acceptance in the marketplace. The volume of sales for solid antiperspirants is expected to increase as utilization of aerosol dispensed antiperspirants decreases due to environmental regulatory pressures.

Contemporary hot-fill solid product dispensers generally require that the consumer push or screw the product upward out of a housing to expose it for application. While these types of devices are functional, they are expensive in that they require either intricate multiple parts or expensive assembling techniques and machinery. Furthermore, and especially in the case of solid antiperspirants, these devices utilize a cylindrical stick having relatively sharp edges which edges cause discomfort to the user when the deodorant stick is originally applied to his or her body.

Therefore, it is an object of this invention to provide a device for packaging and dispensing a hot-fill solid product which device does not require the consumer to screw or push up the product to expose it from its housing.

It is a further object of this invention to provide a device for packaging and dispensing hot-fill solid products which device provides a product shape which is comfortable in use even upon initial application.

The Invention

This invention relates to a device for packaging and dispensing a hot-fill solid product which device comprises: an open-ended, hollow cover having cover coupling means adjacent its open end and having stand-up means on the outside of the cover for supporting the device in an upright position; product holding means for securing the product to the device, the product holding means having a hot-fill port and a first coupling means for forming selective attachment with the cover coupling means whereby the cover and the product holding means form a cavity into which the product is hot-filled; and a handle connected to the product holding means substantially opposite the cavity.

In a preferred embodiment, the cover coupling means and the first coupling means are a pair of cooperating helical threads. Even though it has been found that the utilization of helical threads provides high fidelity selective attachment between the cover and the product holding means, it is understood that other structure may be utilized to achieve selective attachment. For example, a snap-on/snap-off attachment may be achieved by the utilization of a groove and bead as is well-known in the art. It is also preferred that the hollow cover have a hemispherical inside surface. By utilizing the hemispherical surface the hot-fill solid product will have a hemispherical shape which shape provides for comfortable application of the product.

The device of this invention may be adapted to sit upright on the cover or may be adapted to sit upright on the handle. When the device is designed to sit upright on the cover, an annular wall on the outside surface of the lowermost portion of the cover can be provided which will provide a circular wall edge upon which the device can be set. If the device is adapted to sit on the handle the handle may be designed to have a conventional circular planar lowermost portion upon which the device can be rested.

These and other features of this invention contributing satisfaction in use and economy in manufacture will be more fully understood when taken in connection with the following description of preferred embodiments of the invention and the accompanying drawings in which identical numerals refer to identical parts and in which.

Figure 3:
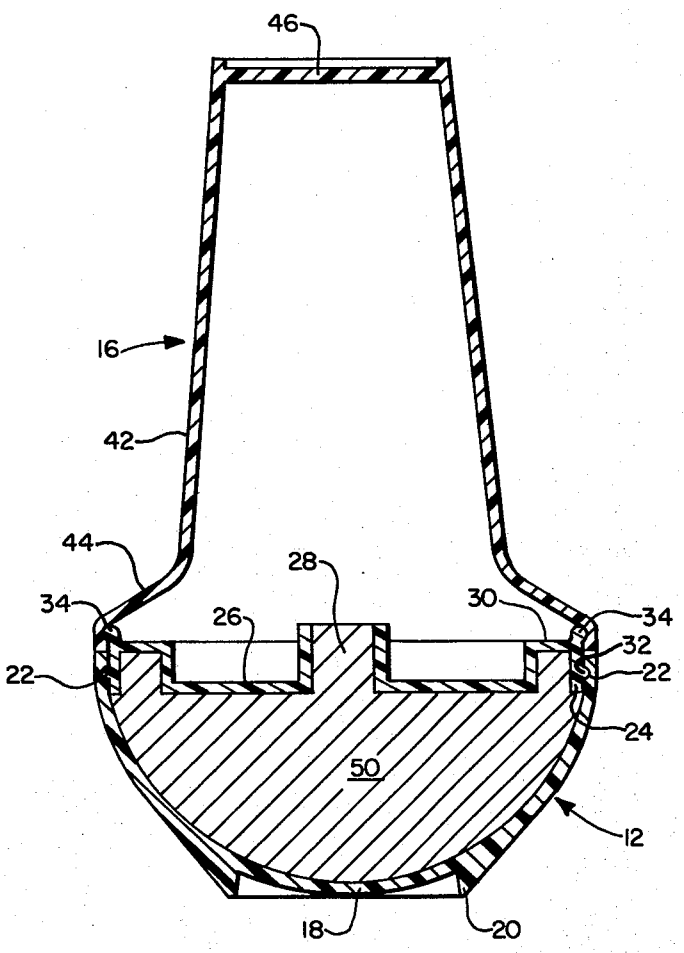
FIG. 3 is a sectional view taken through section lines 3—3 of FIG. 2.
Figure 2:
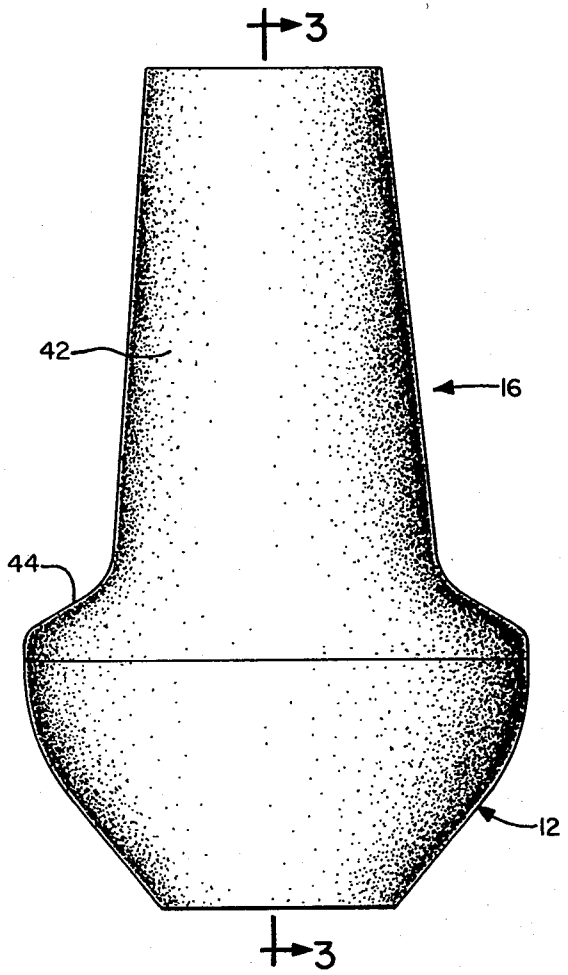
FIG. 2 is a side elevational view of the device shown in FIG. 1.
Figure 4:
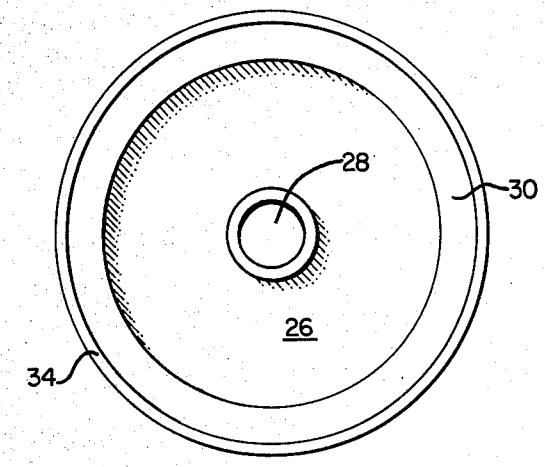
FIG. 4 is a top plan view of the product holder shown in FIG. 1.

Referring now to FIGS. 1–5, it can be seen that a device of this invention, generally designated by the numeral 10; has a cover, generally designated by the numeral 12; a product holding structure, generally designated by the numeral 14; and a handle, generally designated by the numeral 16. Cover 12 has a wall 18 which provides an inside wall having a hemispherical wall surface as is seen in FIG. 3. On the outside surface of wall 18 there is provided an annular downturned wall 20. This downturned wall 20 has a lowermost edge upon which device 10 may rest. Other structure, of course, may be provided other than annular wall 20 which will enable resting of device 10 upon cover 12. For example, cover 12 could have three or more downwardly directed legs having their lowermost ends in a common plane to provide support for device 10 when rested upon cover 12. Other structure serving the same purpose will become readily apparent to those skilled in the art.

Figure 1:
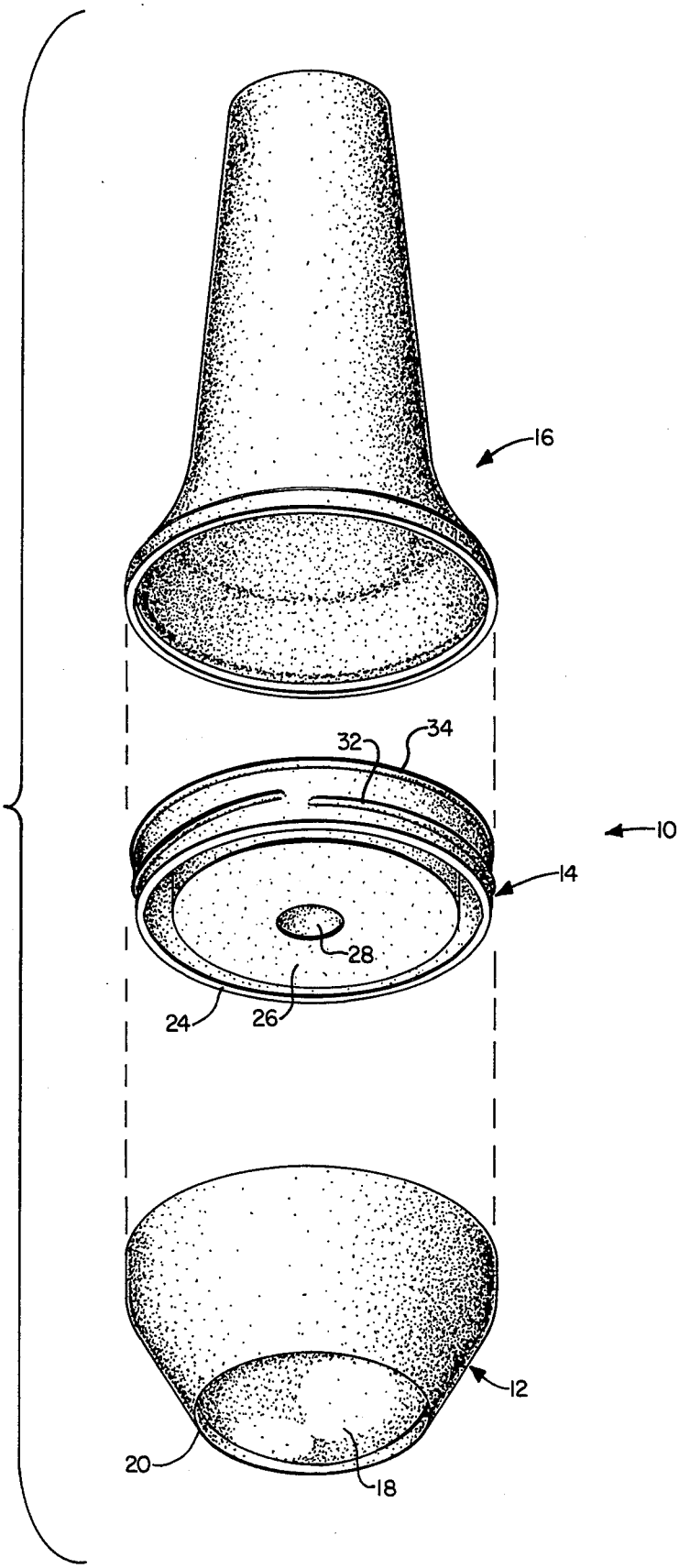
FIG. 1 is an exploded view showing a device of this invention.

Product 50 is a hot-fill solid product such as the material utilized in antiperspirant sticks which are commonplace in today's market. To hold product 50 to device 10 there is provided product holder 14. The effective holding ability of product holder 14 is realized, in part, by using channel 27 which is shown in FIGS. 1 and 3. Channel 27 is formed by an outside annular sidewall 24 and an inside annular sidewall 25 which are connected approximate their uppermost ends by annular top wall 30. Inside annular side wall 25 is connected to annular port wall 29 by way of circular base 26. To provide extra holding power, hot-fill port 28 may additionally be provided. When the hot-fill product is introduced through hot-fill port 28, it will flow into channel 27 and into the recess formed within annular wall 29 thereby creating resistance to unseating of product 50 from product holder 14 due to lateral forces acting on the product when it is being applied by the user. Other structure such as spikes having barbed ends may be utilized by product holder 14 to achieve securement of product 50.

Figure 5:
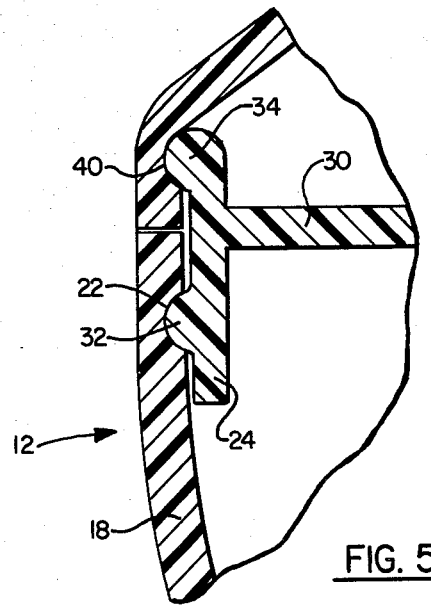
FIG. 5 is an enlarged detail view showing coupling of the product holder to the cover and handle of the device shown in FIG. 1.

Cover 12 is selectively attached to product holder 14 by way of the screwing cooperation between an outwardly extending helical thread 32 about the inside wall of outside annular wall 24 and a hollow helical thread 22 about the inside surface of cover 12 at its open end. This cooperation and attachment is shown in FIGS. 3 and 5. Other selective attachment structure may, of course, be utilized. For example, a snap-on/snap-off relationship may be achieved between cover 12 and product holder 14 by means of these two pieces having, between them, a cooperating annular bead which snaps into an annular groove.

Handle 16 is provided to give the user of device 10 a comfortable grip when applying product 50. The handle shown in the figures was designed to provide as comfortable a grip as possible while still maintaining an aesthetically pleasing appearance. In FIG. 3 it is seen that handle 16 has a slightly upwardly tapered columnar portion 42 which terminates in a flared portion 44. By having a large smooth continuous surface, such a handle will provide a large area upon which the manufacturer of the device of this invention can place labels, decorations, etc. The lowermost end of handle 16 has a hollow groove 40. Hollow groove 40 is dimensioned to receive in a snap-fit relationship annular bead 34 which is located on the uppermost portion of product holder 14. Such a snap-fit will insure a tight rigid attachment between handle 16 and product holder 14 so that these two pieces will be difficult to remove one from the other. In some instances it may be desirable to utilize other means for attachment, such as sonic welding or gluing. At the top of portion 42 there is wall 46 which closes off the handle and also may be used for labeling, decorating, etc.

Figure 6:
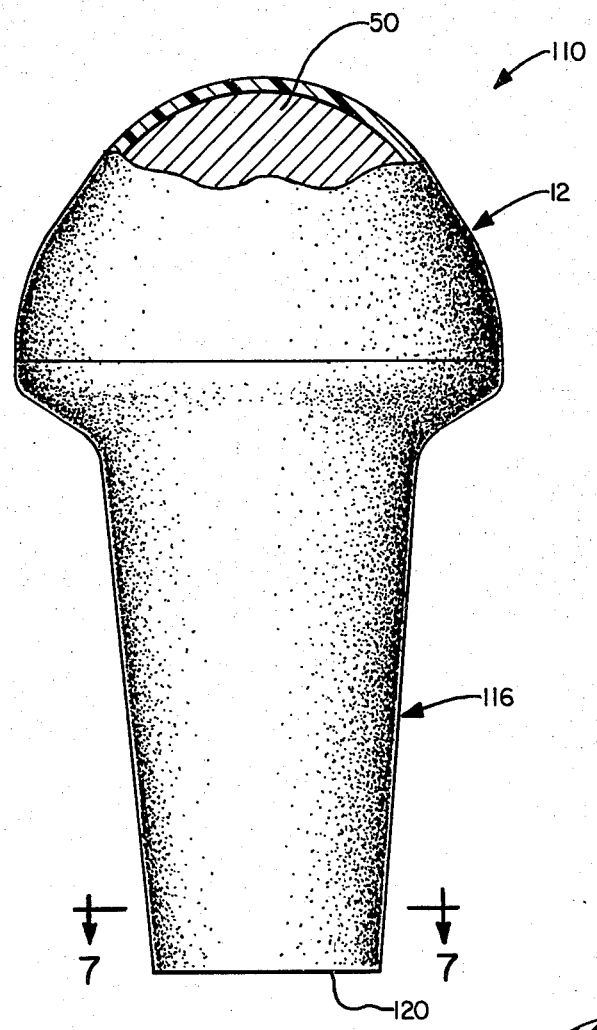
FIG. 6 is a side elevational partially broken view of an embodiment of this invention.
Figure 7:
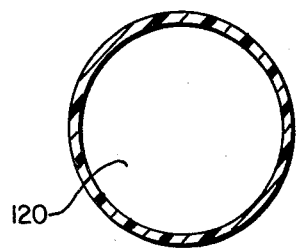
FIG. 7 is a sectional view taken through section lines 7—7 of FIG. 6.

In FIGS. 6–7 there is shown another embodiment of this invention. This embodiment, generally designated by the numeral 110, is identical in all respects to device 10 shown in FIGS. 1–5 except that there is no annular wall on cover 12 to rest device 110. Device 110, instead, is rested on bottom wall 120 of handle 116. Since bottom wall 120 is planar it is ideally suitable for resting device 110 in a cover up portion. Other handle bottom configurations may be used as long as they provide stability for the device.

In some instances it may be desirable that the device of this invention be capable of resting on either cover 12 or the handle portion. The embodiment shown in FIGS. 1–5 is just such a device. Device 10 has the before-described annular wall 20 along with a handle bottom which provides a suitable edge for stable resting of device 10 on handle 16.

The device of this invention can be made by any conventional injection molding techniques. Preferably the material of construction will be any thermoplastic material having suitable rigidity to withstand application forces which the device will experience when product 50 is applied. Also, the material must be able to withstand hot-fill temperatures without deformation. Exemplary of such thermoplastics would be polyolefins having heat of deformation above about 120° F.

Assembly of and filling with product of the device of this invention is the paragon of simplicity. Cover 12 is attached to product holder 14 as a first step. Product 50 is heated until it achieves a molten state. The molten product is then introduced into the cavity formed by cover 12 and product holder 14 through hot-fill port 28. After filling the cavity, handle 16 is attached to product holder 14. The hot product is allowed to cool and then the device is packaged for distribution.

What is claimed is:

1. A device for packaging and dispensing a hot-fill solid product, said device comprising:

a. an open-ended, hollow cover, said cover having cover coupling means adjacent its open end and having stand-up means on the outside of said cover for supporting said device in an upright position;

b. product holding means for securing said product to said device, said product holding means having, i. a hot-fill port, ii. a first coupling means for forming selective attachment with said cover coupling means whereby said cover and said product holding means form a cavity into which said product is hot filled, and iii. a circular channel for aiding in the securement of said product to said device, said channel being formed by an outside annular side wall and a co-axial inside annular side wall connected one to the other adjacent their upper ends by an annular top wall; and, c. a handle connected to said product holding means substantially opposite said cavity.

2. The device of claim 1 wherein the inside surface of said hollow cover is a hemispherical surface.

3. The device of claim 1 wherein said cover coupling means comprises a helical thread and said first coupling means comprises a cooperating helical thread.

4. The device of claim 1 wherein said handle has at one of its ends an annular hollow groove and said product holding means has an outwardly extending annular bead dimensioned to achieve a snap fit within said groove to form said connection between said handle and said product holding means.

5. The device of claim 1 wherein said hot-fill port is coaxial with said channel and said hot-fill port is circumscribed by an upwardly extending port wall to provide a recess wherein said product may be filled to provide additional securement of said product to said device.

6. The device of claim 6 wherein said inside surface of said hollow cover is a hemispherical sphere, said cover coupline means comprises a helical thread and said first coupling means comprises a cooperating helical thread wherein said handle has at one of its ends an annular hollow groove and said product holding means has an outwardly extending annular bead dimensioned to achieve a snap fit within said groove to form said connection between said handle and said product holding means.

7. A device for packaging and dispensing a hot fill solid product, said device comprising:

a. an open-ended, hollow cover, said cover having cover coupling means adjacent its open end;

b. product holding means for securing said product to said device, said product holding means having, i. a hot fill port, ii. a first coupling means for performing selective attachment with said cover coupling means whereby said cover and said product holding means form a cavity into which said product is hot filled, and iii. a circular channel for aiding the securement of said product to said device, said channel being formed by an outside annular side wall and a co-axial inside annular side wall connected to each other adjacent their lower ends by an annular bottom wall; and, c. a handle connected to said product means substantially opposite said cavity and having stand-up means for supporting said device in an upright position.

8. The device of claim 7 wherein the inside surface of said hollow cover is a hemispherical surface.

9. The device of claim 7 wherein said cover coupling means comprises a helical thread and said first coupling means comprises a cooperating helical thread.

10. The device of claim 7 wherein said handle has at one of its ends an annular hollow groove and said product holding means has an outwardly extending annular bead dimensioned to achieve a snap fit within said groove to form said connection between said handle and said product holding means.

11. The device of claim 2 wherein said hot-fill port is coaxial with said channel and said hot-fill port is circumscribed by a downwardly extending port wall to provide a recess wherein said product may be filled to provide additional securement of said product to said device.

12. The device of claim 11 wherein said inside surface of said hollow cover is a hemispherical sphere, said cover coupline means comprises a helical thread and said first coupling means comprises a cooperating helical thread wherein said handle has at one of its ends an annular hollow groove and said product holding means has an outwardly extending annular bead dimensioned to achieve a snap fit within said groove to form said connection between said handle and said product holding means.

* * * * *

UNITED STATES PATENT AND TRADEMARK OFFICE

CERTIFICATE OF CORRECTION

PATENT NO. : 4,235,557

DATED : November 25, 1980

INVENTOR(S) : Thomas H. Hayes

It is certified that error appears in the above-identified patent and that said Letters Patent are hereby corrected as shown below:

Page 1, in the Abstract, line 5 reads "produce", should read -- product --.
Claim 6, line 1, reads "6", should read -- 5 --.
Claim 11, line 1, reads "2", should read -- 7 --.
Claim 12, line 3, reads "coupline", should read -- coupling --.

Signed and Sealed this

*Seventeenth* Day of *November 1981*

[SEAL]

*Attest:*

GERALD J. MOSSINGHOFF

*Attesting Officer* *Commissioner of Patents and Trademarks*